United States Patent [19]

Moffatt

[11] 4,337,508

[45] Jun. 29, 1982

[54] HIGH WATTAGE LAMP FIXTURE

[75] Inventor: David A. Moffatt, Lutsen, Minn.

[73] Assignee: Moffatt Products, Inc., Lutsen, Minn.

[21] Appl. No.: 173,976

[22] Filed: Jul. 31, 1980

[51] Int. Cl.[3] ..... F21V 29/00

[52] U.S. Cl. ..... 362/294; 362/275; 362/287; 362/295; 362/413; 362/414; 362/431; 362/448

[58] Field of Search ..... 362/294, 275, 287, 295, 362/413, 414, 431, 448

[56] References Cited

U.S. PATENT DOCUMENTS 3,388,249 6/1968 Siegel et al. ..... 362/413

3,626,424 12/1971 Kahn ..... 362/294

*Primary Examiner*—Stephen J. Lechert, Jr.

*Attorney, Agent, or Firm*—Kinney, Lange, Braddock, Westman & Fairbairn

[57] ABSTRACT

An incandescent lamp fixture includes an incandescent lamp screwed into a plastic lamp socket, a metallic heat dissipater in intimate heat transfer contact with the socket and having heat dissipating fins extending out from the socket. A metallic reflector surrounds the lamp and is mounted on the dissipater in heat transfer contact with it. An open-ended cylindrical lamp shade is connected to the heat dissipater and is in spaced, concentric relation to the dissipater, socket and lamp to permit free flow of air heated by the fixture to pass between the outside of the reflector and through the fins of the dissipater on the one side and the interior of the shade on the other. This will keep the temperature of the lamp base below the breakdown temperature of the socket and switch and below the breakdown temperature of the cement between the lamp base and the lamp bulb. A switch assembly includes a switch base mounted to the lamp socket and incoming power wires mounted directly on the switch base. A switch toggle and a moving switch contact controlled by the toggle are also directly mounted on the switch base.

5 Claims, 9 Drawing Figures

HIGH WATTAGE LAMP FIXTURE

BACKGROUND OF THE INVENTION

This invention has relation to high wattage incandescent lamp fixtures of the type sometimes referred to as "goose neck lamp" fixtures. Such a lamp is used to provide a high level of illumination on a specific area. Such a lamp is illustrated in the expired patent to Dillon W. Moffatt, U.S. Pat. No. 3,945,946, granted July 19, 1960.

In order to provide the highest possible level of illumination from such a lamp fixture, it is often desirable to increase the wattage of the incandescent lamp supported in the fixture. This can be done successfully over relatively short periods of time. There are two limiting factors.

The first is the ability of the socket and the switch mechanism to withstand the heat. Using 100 watt bulbs, many lamps presently in commerce today will develop temperatures over 330° F. (165° C.), and the materials presently available for switches and sockets cannot stand such temperatures for extended periods.

The second limiting factor is the ability of the bonding cement between the glass bulb and the metallic base of the incandescent lamp to withstand heat. When this cement breaks down, the bulb comes loose from the base, and any attempted rotation or other movement of the glass bulb does not find its counterpart in movement of the metallic base, and the incandescent lamp fails.

In the past, metallic finned heat sinks have been used around semi-conductors, for example, to try to dissipate the heat from the semi-conductor to prevent breakdown. For example, see heat sink No. 2257R manufactured by Thermalloy Inc. of Dallas, Tex. and shown in their Catalog 75-SF-9, copy attached. Similar extruded aluminum finned heat sinks have been assembled around lamp sockets to attempt to reduce the temperature of the socket itself, but such heat sinks have been situated in spaced relation to the socket, thus minimizing the heat transfer from the socket outwardly into the sink. See attached copy of catalog sheet of LMH Series Low Bay Luminaires by Widelite of San Marcos, Texas. Applicant is not aware of when the Widelite structures were first offered for sale and so does not know if they are prior art.

A feature of the Moffatt lamp as shown in the expired patent referred to above was in the cooling of the outside lamp shade so that accidental or purposeful contact with that shade by an artisan in using the useful field of light from the lamp fixture would not be painful or disruptive.

The above-referred to Widelite lamp cannot be utilized to provide such cooling to the outside lamp shade.

In order to overcome these difficulties with the prior art, the lamp of the present invention was developed.

Applicant and those in privity with him know of no closer prior art than that set out above; and they know of no prior art which anticipates the claims made in this application. No formal search of the prior art in the Patent Office was performed in regard to this invention.

BRIEF SUMMARY OF THE INVENTION

An incandescent lamp fixture capable of supporting indefinitely an electrically energized high wattage lamp bulb includes a plastic socket into which the bulb is screwed in the usual manner; a finned heat dissipater of a material highly conductive to heat and situated in intimate contacting relationship around the outer periphery of the socket; a highly reflective reflector also of material highly conductive to heat, the reflector being supported in intimate heat transfer relationship from and with respect to the finned heat dissipater; and an open ended outer cylindrical sleeve concentric with the lamp bulb, the heat dissipater and the reflector, the sleeve being spaced outwardly from the dissipater and reflector to allow passage of ambient air between the reflector and the sleeve and past the fins of the heat dissipater. This combination insures that the breakdown temperature of the cement holding the lamp bulb to the metallic lamp base will not be exceeded.

A switch assembly includes a switch base of electrically non-conductive material fastened directly to the heat dissipater to hold the base in intimate contact with and across the top of the lamp socket. Electrical leads mounted on this switch base extend down into the socket to provide electrical contacts for the incandescent lamp when it is installed and energized. Electrical wires extend to appropriate terminals on the base. Arms integral with and extending upwardly from the switch base pivotally support a contact arm carrying a moving electrical contact or hammer. A spring actuated switch toggle controls this contact arm to selectively make and break the continuity of the wires, terminals and leads to energize and denergize the incandescent lamp.

A switch cap, integrally connected to an upper open portion of the cylindrical outer sleeve of the lamp encompasses the switch assembly and is fastened in provided openings between adjacent fins of the heat dissipater in position to cover, hold and protect the switch assembly.

IN THE DRAWINGS

DESCRIPTION OF PREFERRED EMBODIMENT

Figure 2:
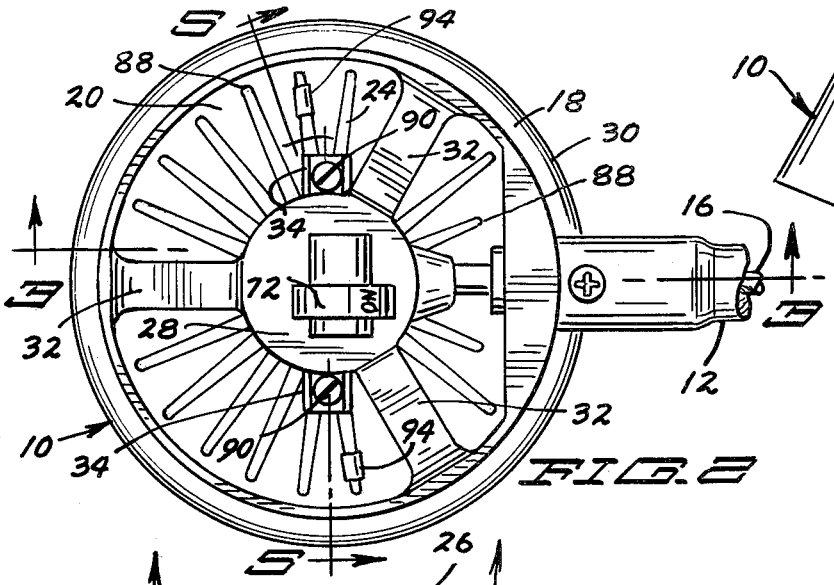
FIG. 2 is an enlarged top plan view of the lamp of FIG. 1.
Figure 1:
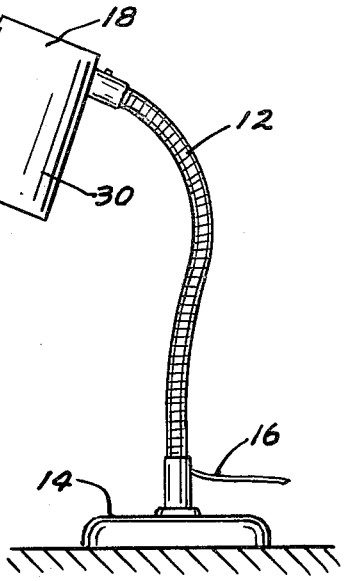
FIG. 1 is a side elevational view of a high wattage incandescent lamp fixture showing its general relationship to a flexible arm and a base.
Figure 3:
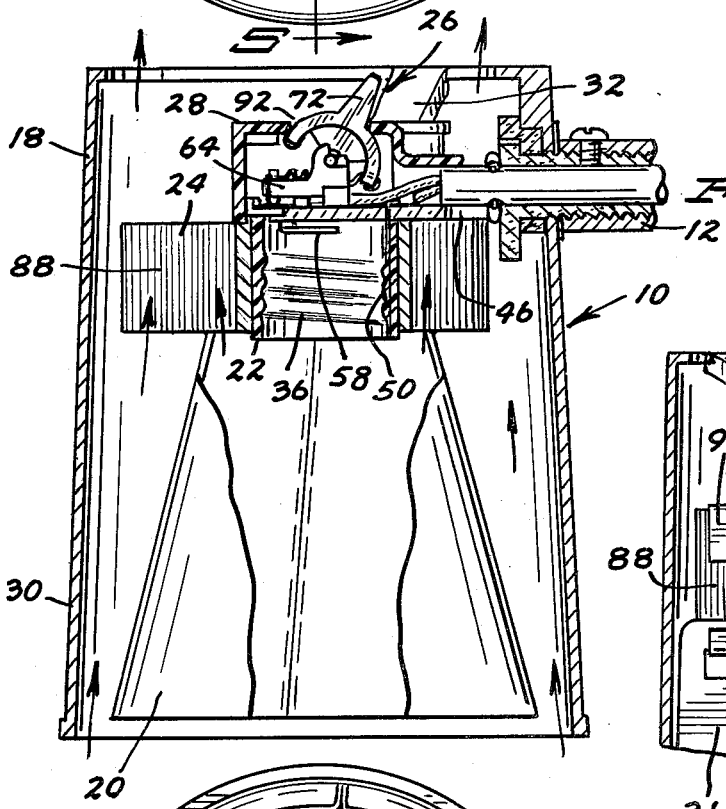
FIG. 3 is a vertical sectional view taken on the line 3—3 in FIG. 2.

A high wattage incandescent lamp fixture 10 is connected to a flexible arm 12 supported by a base 14. An electrical conduit 16 carries power to the lamp fixture 10 through the flexible arm 12.

The lamp fixture includes a lamp shade 18 of a non-conducting material such as polyester; a two-piece, generally conical, flanged reflector 20 of a material such as aluminum, each piece having a pair of flanges 21,21; a lamp socket 22 of a suitable electrically non-conducting plastic material; and a finned heat sink or heat dissipater 24 in intimate heat conducting relationship with respect to the socket 22 and the upper edge of the reflector 20.

A switch assembly, indicated generally at 26, is supported on top of the lamp socket 22 and is held in position by a socket-like switch cap 28 forming a part of the lamp shade 18. This switch cap 28 is integrally connected to an outer cylindrical sleeve 30 of the shade through the instrumentality of three spider arms 32. The switch cap 28 of the lamp shade 18 has a pair of horizontally extending ears 34,34 for the purpose of assembling the shade to the lamp socket 22 and the heat dissipater 24 in a manner to be described.

The lamp socket 22 is provided with ridges and grooves or threads 36 to receive the ridges and grooves or threads 37 of an aluminum or other metallic lamp base 38 of an incandescent lamp 40. The lamp 40 also includes a glass bulb 42 cemented into the base 38 by cement 44.

The switch assembly 26 includes an electrically non-conductive switch base 46. A neutral wire terminal 48 extends down through the switch base to provide a vertical copper bar 50 extending down a provided groove in the socket 22 in such a position that when the lamp 40 is screwed into the socket, the lamp base 38 will make electrical contact with the copper bar 50. This neutral wire terminal 48 is connected to a neutral wire 52 which is one of the three wires provided by the electrical conduit 16.

A positive wire terminal 54 receives a positive wire 56 from the electrical conduit 16. This positive wire terminal and contact 54 extends to a forward upper portion of the switch base 46. Also at that forward portion of the switch base is a socket center contact 58 which extends down through the switch base 46 to be in a position to contact a center terminal 60 of the incandescent lamp 40.

A moving contact or hammer 62 is mounted on an outer end of a spring actuated contact arm 64. When this arm 64 comes down, the hammer or moving contact 62 electrically connects the center terminal 60 through socket center contact 58 to the positive wire terminal 54, thus completing the circuit through lamp 40.

A pair of socket posts 66,66 of the socket 22 extend upwardly through provided openings in the switch base 46 and each such post is provided with a snap-fit part cylindrical bearing surface 68 which receives cylindrical outwardly extending toggle switch support arms 70,70 of a switch toggle 72. The spring actuated contact arm 64 is freely pivotally mounted on outer ends of the toggle switch support arms 70. An actuating coil spring 74 is connected to the contact arm 64 as at 76 and to the switch toggle 72 as at 78 in such a manner that when the switch toggle is positioned in the "ON" position as seen in FIGS. 2, 3, 6, and 7, the spring 74 will firmly hold the contact arm 64 to cause the hammer 62 to make electrical contact between the terminal 54 and contact 58.

A third or ground wire 80 extends from the electrical conduit 16 and is fastened to the heat dissipator 24 through the instrumentality of a grounding terminal 82 and a screw 84.

The outside surface of lamp socket 22 is cylindrical, and the aluminum heat dissipator 24 consists of an inner cylindrical portion 86 and integral outwardly extending heat dissipating fins 88. The parts are sized so that the heat dissipator 24 can slip over the lamp socket 22. The socket 22 is split from top to bottom as at 23 and is slightly smaller than the base 38 of the incandescent lamp so that when the lamp is screwed into the socket, the socket is pressed outwardly into maximum heat-conductive contact with the heat sink or heat dissipator 24. By using the relatively stronger internal cylindrical portion of the heat dissipator 24 to back up and support the socket 22, the socket can be much lighter and does not have to stand the hoop stresses developed from an over-tightened bulb. These stresses, in the present structure, are transmitted to the heat dissipator.

Figure 5:
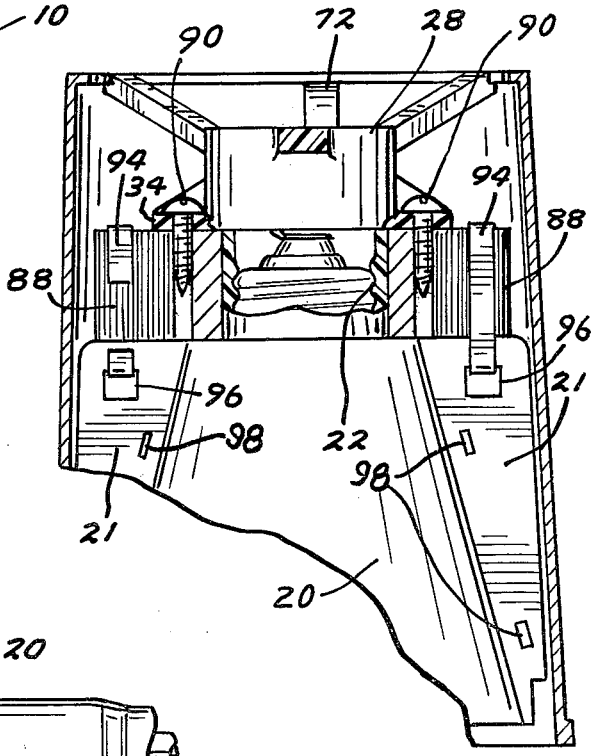
FIG. 5 is a vertical sectional view taken on the line 5—5 in FIG. 2.
Figure 4:
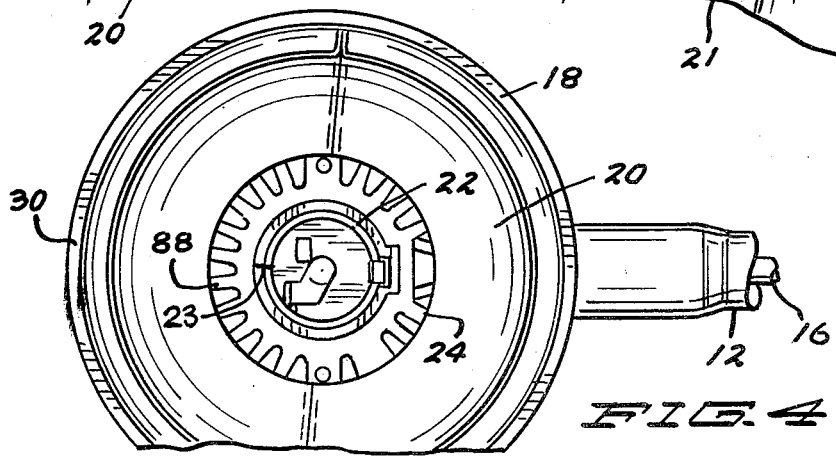
FIG. 4 is a fragmentary bottom plan view of the lamp in FIGS. 1 through 3.

Each of the flanges 21,21 of each of the halves of the two-piece reflector 20 are provided with rectangular openings 96 therethrough. Each fin is fixedly positioned to an adjacent fin by suitable fastening means, illustrated at 98. The reflector 20 is positioned up against the heat dissipator 24 as seen FIGS. 3 and 5, and a spring clip 94 is extended over the top of one of the heat dissipating fins 88 and through the provided rectangular opening 96 in the flanged reflector 20 to securely hold the reflector in heat conducting relationship with respect to the heat dissipator.

Figure 7:
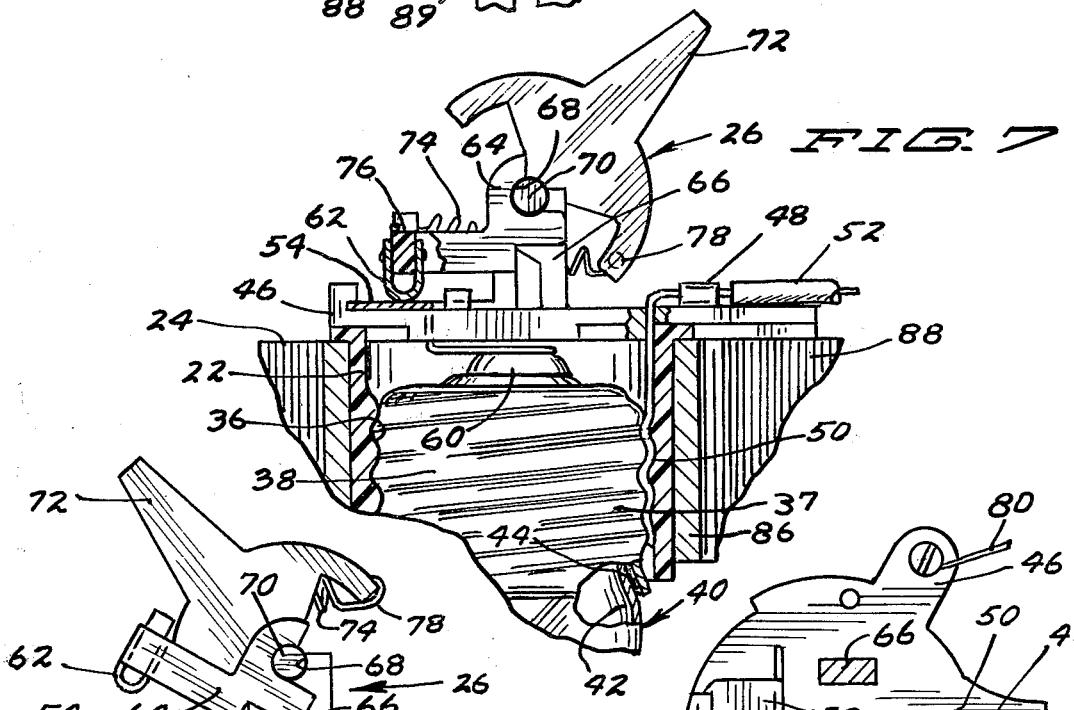
FIG. 7 is a fragmentary vertical sectional view taken on the line 7—7 in FIG. 6 and showing the lamp switch in the "ON" position.
Figure 8:
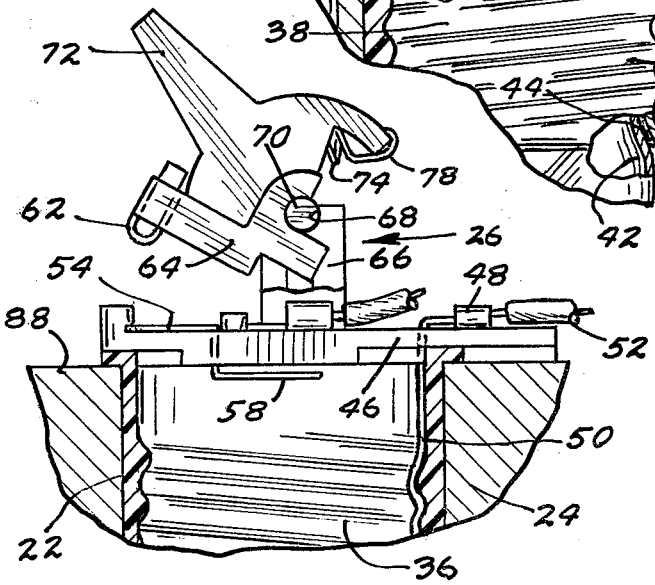
FIG. 8 is also a fragmentary vertical sectional view taken approximately on the line 7—7 in FIG. 6, but showing the switch in the "OFF" position.
Figure 9:
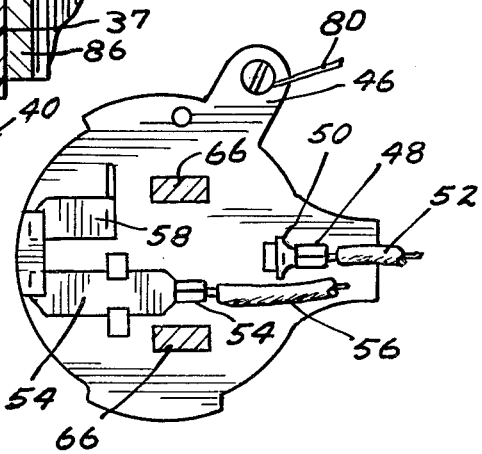
FIG. 9 is a top plan view of the switch base taken in the same relative position as FIGS. 2 and 6 with parts broken away and showing the relationship between the switch base and the incoming electrical leads.

At the root of two adjacent fins 88 on each side of the heat dissipator, there is provided a C-shape vertical opening 89. After the switch assembly 26 and the socket have been assembled together as seen in FIGS. 6, 7 and 8, and the reflector 20 has been affixed to the heat dissipator, the lamp shade 18 is set down over the top of the heat dissipator and switch assembly, and self-tapping screws 90,90 are inserted through provided openings in the horizontally extending ears 34,34 of the socket-like switch cap 28 of the lamp shade 18 and these C-shape openings 89,89 in the heat dissipator to allow the switch toggle 72 to extend through a provided opening 92 in the switch cap 28, and to positively position the lamp shade with respect to the switch assembly, the socket, the heat dissipator and the reflector 20.

Figure 6:
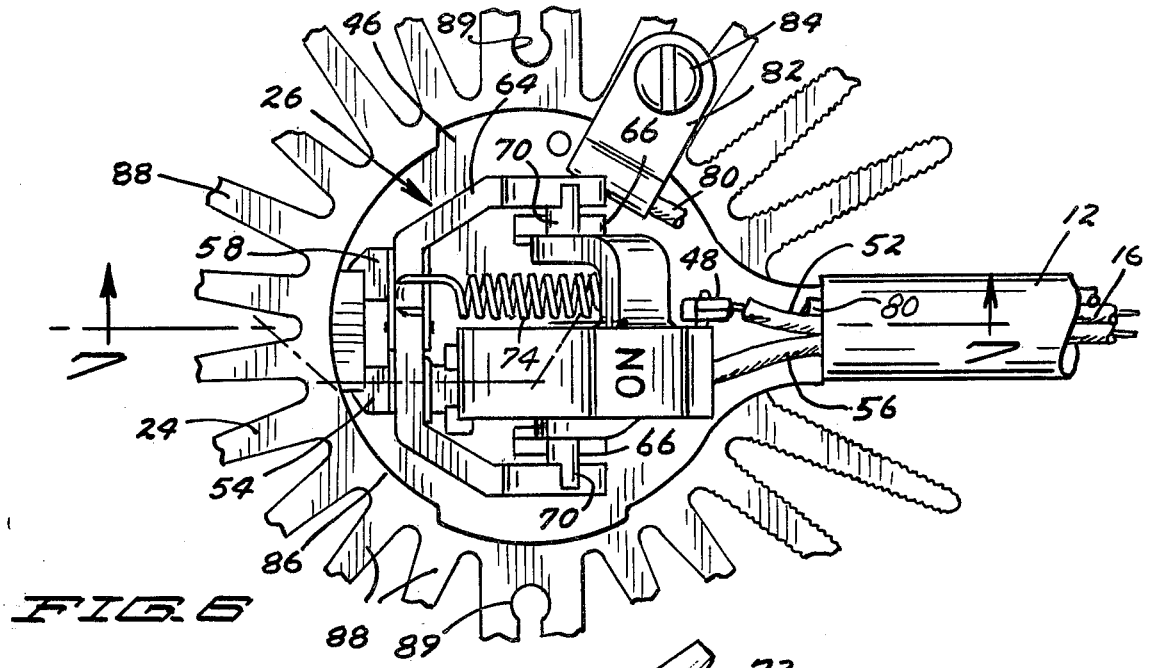
FIG. 6 is an enlarged fragmentary top plan view of a socket, switch base and switch preassembly taken in the same relative position as in FIG. 2 but before being assembled to a lamp shade or cylindrical sleeve.

In FIG. 6, four heat dissipating fins 88 are shown as being serrated to increase surface area and, therefore, heat transfer away from heat dissipator 24. Actually all surfaces of all fins 88 are so serrated as suggested in FIGS. 3, 5 and 7.

I claim:

1. For use with a source of electrical energy and an incandescent lamp having a metallic base, a translucent bulb and a metallic center terminal, an incandescent lamp fixture including:

A. a lamp socket of non-electrically conductive material of configuration to receive and retain a metallic lamp base;

B. a first electrical contact in said socket in position to contact said lamp base;

C. a second electrical contact in said socket in position to contact a center terminal of said lamp;

D. electrical circuit means to transmit energy to said first and second electrical contacts;

E. a heat dissipater of material highly conductive to heat in intimate surrounding continuous contact with an outer surface of said socket over an area at least equivalent and opposite an inner surface facing and contacting said lamp base, said heat dissipater having heat dissipating fins extending radially outwardly from the lamp socket;

F. an open-ended lamp shade fixedly mounted with respect to said dissipater in concentric spaced relation with respect to said socket, said shade encompassing said electrical circuit means, said socket and said heat dissipater and extending past said socket sufficiently to encompass an incandescent lamp when mounted in said socket; and G. a reflector of material highly conductive to heat and mounted in surrounding relation to said socket in intimate heat conductive relation to said dissipater and in concentric but spaced relation from and inside of said lamp shade.

2. The lamp fixture of claim 1 wherein:

H. said lamp shade also being in spaced relation with respect to said fins of said heat dissipater.

3. The lamp fixture of claim 2 wherein:

I. said electrical circuit means including:

(1) a switch base of electrically non-conductive material supported in intimate heat transfer relation to the heat dissipater and lying across the closed end of the socket, (2) first and second switch terminals fixed on said switch base, each of said terminals being electrically connected to one of said first and second electrical contacts, (3) first and second energized electrical wires extending from a source of electrical energy through said shade and each terminating at one of said first and second terminals, and (4) switch means mounted on said switch base, said switch means being manually operable to selectively make and break the continuity of the electrical connection between at least one of said electrical contacts and its associated terminal.

4. The lamp fixture of claim 3 wherein:

J. said switch means includes:

(1) a contact arm pivotally mounted in spaced relation to said switch base on a first axis, (2) a switch toggle pivotally mounted in spaced relation to said switch base on said first axis, (3) an electrically conductive hammer on said switch contact arm, (4) resilient means urging said contact arm to move said hammer in direction toward said switch plate responsive to positioning of said switch toggle in a first position, and urging said contact arm and hammer in a direction away from said switch plate responsive to positioning of said switch toggle in a second position, (5) one of said first and second electrical contacts having a first hammer contact surface situated on said switch base in position to be contacted by said hammer when it is being urged toward said switch plate, and (6) one of said first and second terminals having a second hammer contact surface situated on said switch base adjacent but electrically isolated from said first hammer contact surface in position to be contacted by said hammer to complete an electrical connection to said first hammer surface when the hammer is being urged toward the switch plate.

5. The lamp fixture of claim 4 wherein:

K. a hollow switch cap is integrally connected in concentric relation to said lamp shade by a plurality of arms extending between the shade and cap;

L. said lamp shade is fixedly mounted with respect to the heat dissipater through the instrumentality of ears on the cap being fastened directly to the heat dissipater; and M. said switch cap is of configuration to retain said switch means in protected operable condition, and is provided with an opening in position to receive and to make accessible a manually operable portion of said switch toggle.

* * * * *